US005955830A

United States Patent [19]

Uyama

[11] Patent Number: 5,955,830

[45] Date of Patent: Sep. 21, 1999

[54] CATHODE RAY TUBE WITH ELECTRON BEAM CONVERGENCE REGULATOR

[75] Inventor: Toshio Uyama, Chiba-ken, Japan

[73] Assignee: Hitachi, Ltd., Tokyo, Japan

[21] Appl. No.: 08/856,281

[22] Filed: May 14, 1997

[30] Foreign Application Priority Data

May 15, 1996 [JP] Japan ..... 8-120016

[51] Int. Cl.[6] ..... H01J 29/70; H01J 29/54; H01J 29/68

[52] U.S. Cl. ..... 313/412; 313/428; 313/421; 335/212

[58] Field of Search ..... 313/412, 449, 313/428, 431, 437

[56] References Cited

U.S. PATENT DOCUMENTS

| | | | |
|---|---|---|---|
| 3,808,570 | 4/1974 | Thompson et al. | 335/212 |
| 4,091,347 | 5/1978 | Barin | 335/212 |
| 4,670,726 | 6/1987 | Ogata et al. | 313/427 |
| 5,157,302 | 10/1992 | Tanaka | 313/412 |
| 5,227,753 | 7/1993 | Hirai et al. | 335/212 |
| 5,289,149 | 2/1994 | Nishita et al. | 335/212 |
| 5,350,978 | 9/1994 | Chen | 315/368.15 |
| 5,399,933 | 3/1995 | Tsai | 313/31 |
| 5,530,315 | 6/1996 | Arimoto . | |
| 5,557,164 | 9/1996 | Chen et al. | 313/440 |
| 5,708,323 | 1/1998 | Okamoto | 313/431 |

FOREIGN PATENT DOCUMENTS 94114446 9/1994 European Pat. Off. .

*Primary Examiner*—Vip Patel
*Assistant Examiner*—Matthew T. Gerike
*Attorney, Agent, or Firm*—Antonelli, Terry, Stout & Kraus, LLP

[57] ABSTRACT

A cathode ray tube has a convergence regulating means 7, positioned on the periphery of a neck portion 1B, which is used for regulating the orbit of each electron beam emitted from electron guns contained in the neck portion 1B of the CRT envelope. The convergence regulating means 7 is equipped with high magnetic permeability members 18 for preventing the electron beam from being affected by terrestrial magnetism. Each of the high magnetic permeability members is spaced from the outer peripheral face of the envelope without direct contact therewith. With this arrangement the glass of the neck portion is prevented from deterioration.

19 Claims, 4 Drawing Sheets

CATHODE RAY TUBE WITH ELECTRON BEAM CONVERGENCE REGULATOR

BACKGROUND OF THE INVENTION

The present invention relates to a cathode ray tube and more particularly to improvements in its convergence regulator.

Cathode ray tubes are used for displaying images by deflecting electron beams from an electron gun and irradiating a phosphor screen with the electron beams. The formation of such an image on the phosphor screen is dependent on the intensity of the electron beams during the process of deflecting them.

Therefore, the formation of a reliable image is based on the deflection of electron beams with extreme precision and it is set forth as a premise that spots on a phosphor screen to be irradiated with the electron beams have to be precisely irradiated therewith.

Particularly in the case of a color cathode ray tube in which it has to be arranged that three electron beams from electron guns are directed to adjoining phosphors of three colors for use in different color development, spots on a phosphor screen to be irradiated with the electron beams need all the more precise irradiation.

If one of the electron beams fails to irradiate the target phosphor, color misregistration will occur.

Consequently, a convergence regulator is provided on the outer periphery of a so-called neck portion of the envelope for containing the electron guns of a cathode ray tube. With the provision of the convergence regulator, each electron beam is finely regulated in such a manner that a predetermined spot on a phosphor screen is precisely irradiated with each electron beam.

As disclosed in Japanese Patent Laid-Open No. 250335/1995 (corresponding European Patent Application No. 94114446.1), further, high magnetic permeability members are arranged in a neck portion so as to prevent electron beams from being affected by terrestrial magnetism, whereby highly reliable convergence regulation is attainable.

FIG. 8 is a sectional view of a neck portion in the prior art, wherein there are shown magnet plates 21, a holder 22, a neck portion 23 and high magnetic permeability members 24.

Each of the high magnetic permeability members is made of a conductive metal material and is formed as a member adhering to the neck-side inner wall surface of a convergence regulator to be mounted on the neck portion. Consequently, the high magnetic permeability members are placed on the interface between the convergence regulator and the neck portion.

In a cathode ray tube of the sort in which the high magnetic permeability members closely adhere to the neck portion, however, the withstand voltage of the neck portion of the envelope is insufficient.

Since a voltage as high as approximately 8–15 kV is applied to the electrode of the electron gun structure enclosed in the neck portion, the inner wall surface of the neck portion is charged with a voltage at the same level as the level of what has been applied thereto.

On the other hand, the high magnetic permeability members are formed in direct contact with the outer peripheral face of the neck portion. For this reason, the inner wall surface charged with the high voltage and the high magnetic permeability members are arranged close to each other and the withstand voltage therebetween tends to become insufficient.

In case a scratch so tiny as to be invisible or latent exists in the glass material forming the neck portion, it is a matter of considerable concern that deterioration in the pressure resistance of the glass will be accelerated and in the worst case, the neck portion will be broken.

SUMMARY OF THE INVENTION

An object of the present invention, made in view of the foregoing situation, is to provide a cathode ray tube characterized in that the pressure resistance of the glass in the neck portion of the envelope has been increased.

In order to accomplish this object, a cathode ray tube according to the present invention is characterized in that a convergence regulating means for regulating the orbit of each electron beam from an electron gun is positioned on the periphery of a neck portion; the convergence regulating means is equipped with high magnetic permeability members for preventing the electron beam from being affected by terrestrial magnetism; and each of the high magnetic permeability members is spaced from the outer peripheral face of an envelope so as to not be in direct contact therewith.

Even though the inside of the neck portion of the cathode ray tube thus constructed is charged with a high voltage, the potential difference between the inside of the neck portion and the high magnetic permeability members can be decreased because the high magnetic permeability members positioned on the outer periphery of the neck portion are sufficiently separated from the outer surface of the neck portion.

Consequently, the pressure resistance of the neck portion is increased.

DESCRIPTION OF THE PREFERRED EMBODIMENTS

An embodiment of the present invention will subsequently be described by reference to the appended drawings.

Figure 7:
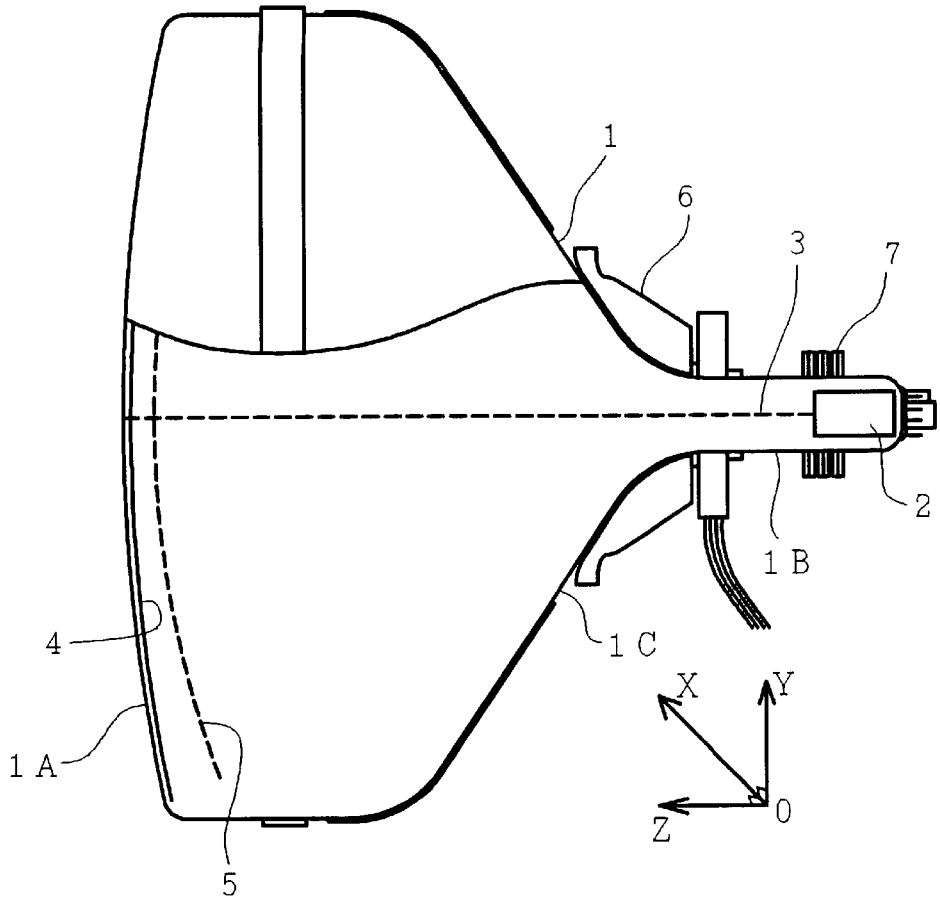
FIG. 7 is an overall diagram of the cathode ray tube according to the present invention.
Figure 8:
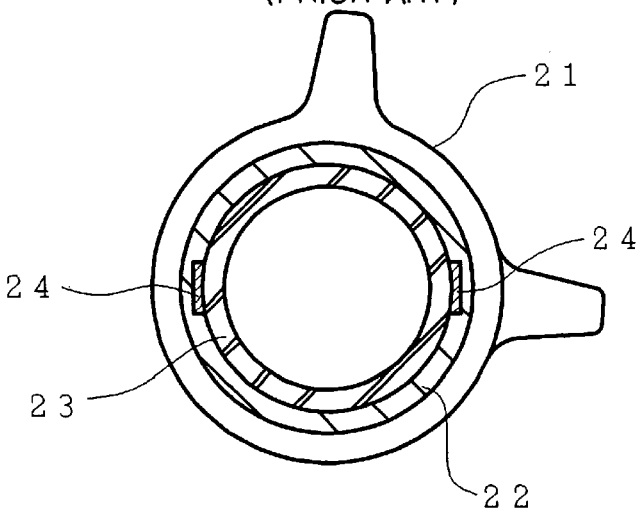
FIG. 8 (PRIOR ART)
FIG. 8 is a sectional view of the neck portion of a conventional cathode ray tube.

FIG. 7 is an overall schematic diagram of a cathode ray tube according to the present invention.

In FIG. 7, there is shown an envelope 1 of a cathode ray tube, the envelope being made of glass.

The envelope 1 has a panel portion 1A as the display portion of the cathode ray tube, a neck portion 1B containing the electron guns and a funnel portion 1C for smoothly joining the panel portion 1A and the neck portion 1B.

An electron gun structure 2 is placed in the neck portion 1B. In the electron gun structure 2 there are three cathodes that are arranged in a row and constitute a so-called inline type electron gun; more specifically, electron beams 3 for red (R), green (G) and blue (B) light emission are emitted from the respective cathodes.

Further, a phosphor layer 4 is formed over the whole inner wall surface of the panel portion 1A and, in an area corresponding to one pixel, phosphor layers for red (R), green (G) and blue (B) light emission are formed adjacent to one another.

The phosphor layers for red (R), green (G) and blue (B) light emission, each corresponding to one pixel, are irradiated by the respective electron beams 3 fired from the electron gun structure 2.

In this case, a shadow mask 5 is placed opposite to the inner wall surface of the panel portion 1A where the phosphor layer 4 is formed, the shadow mask 5 having electron beam passing openings bored opposite to corresponding pixels.

Each of the electron beams 3 from the electron gun structure 2 is allowed to pass through a corresponding electron beam passing opening in the shadow mask 5. Consequently, the electron beam is properly positioned on the back side of the shadow mask 5 and the phosphor layer for color light emission for each pixel corresponding to the proper electron beam passing opening is irradiated therewith.

On the other hand, a deflection yoke assembly 6 is installed outside the envelope 1 on the side of the neck portion 1B extending out of the funnel portion 1C. Due to the function of the deflection yoke assembly 6, each pixel on the phosphor layer 4 is scanned so that it can be irradiated with each electron beam 3 that has been deflected horizontally or vertically.

A convergence regulating means 7 is provided at a position outside the neck portion 1B of the envelope 1. The convergence regulating means 7 is used for irradiating the phosphor layer 4 with the electron beams from the electron gun structure 2 and when a deviation in the position of the electron beam 3 occurs, regulates the orbit of the beam in order to correct any deviation in the position thereof.

Figure 1:
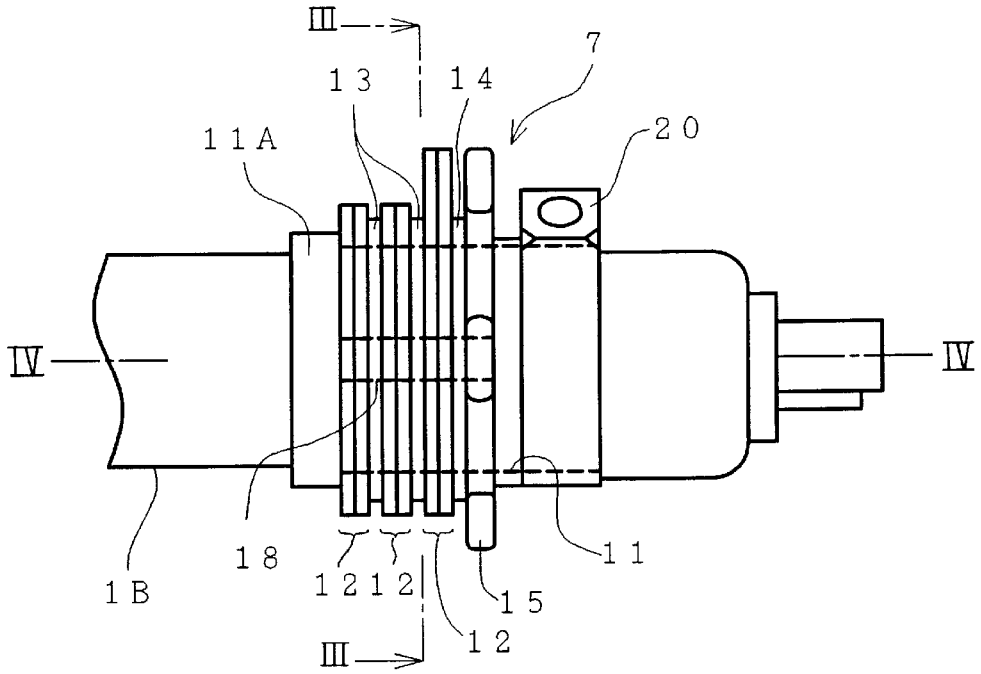
FIG. 1 is a diagram of the principal part in a cathode ray tube embodying the present invention.
Figure 2:
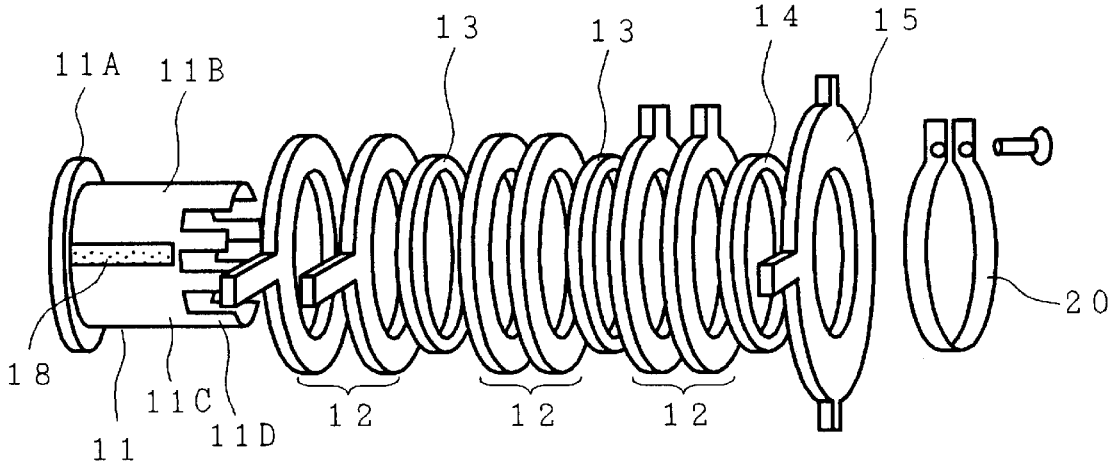
FIG. 2 is an exploded perspective view of a convergence regulating means with which the cathode ray tube is fitted according to an embodiment of the present invention.

FIG. 1 is a side view of the convergence regulating means 7 in detail, and FIG. 2 is an exploded view thereof.

The neck portion 1B of the envelope 1 of the cathode ray tube is fitted with a holder 11. The holder 11 is a cylindrical member into which the neck portion 1B is fitted; a flange 11A is provided at one end of the holder 11, whereas a metal fitting portion 11D is provided at the other end and is fitted to the neck portion 1B by means of metal fittings 20. Further, the holder 11 has a side portion 11B extending from the flange 11A, and a screw portion 11C for use in tightening the holder with a lock ring 15.

Further, three sets of pairs of magnet plates 12 are arranged with spacer rings 13 which are each held between the pairs of magnet plates, so that the holder 11 is fitted into the magnet plates together with the spacer rings from the side of the metal fitting portion 11D.

Figure 3:
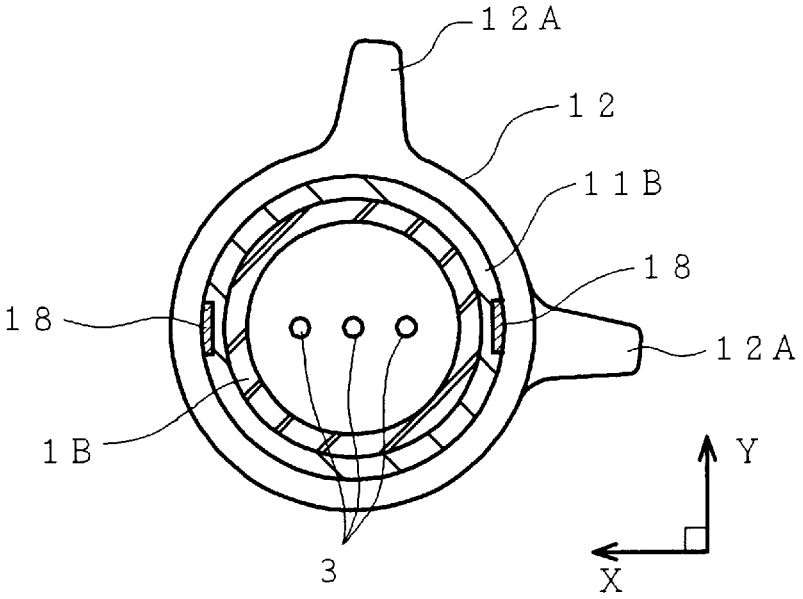
FIG. 3 is a sectional view taken on line A—A of FIG. 1.

FIG. 3 is a sectional view taken on line A—A of FIG. 1.

Each magnet plate 12 is in the form of a ring with a hole into which the holder 11 is fitted, and the plate 12 is provided with a knob 12A in part of its outer peripheral portion. Further, each magnet plate 12 is locally magnetized (not shown) but the number of magnetizations and the arrangement thereof differ among different magnet plates.

Each magnet plate 12 may be supported so as to be rotatable independently and optionally round the side portion 11B of the holder 11, whereby the magnetic field distribution in an electron beam passage portion within the neck portion 1B is variable. Moreover, the presence of the knob 12A makes possible a slight rotation of such a magnet plate 12 with ease.

When the electron beam 3 fired to the center of the phosphor layer 4 experiences a deviation in position with respect to the center thereof, for example, the orbit is adjustable so that it may be directed to that center position by varying the magnetic field distribution.

Each spacer ring 13 is also in the form of a ring with a hole into which the holder 11 is fitted, and the spacer ring is provided with a projection (not shown) in part of its inner peripheral portion.

When the holder 11 is fitted into the spacer ring 13, the projection is fitted into a groove (not shown) formed in the z direction of the outer peripheral face of the holder 11; that is, the projection is provided for use in suppressing the rotation of the spacer ring 13.

In other words, the aforementioned projection is used to prevent another adjacent magnet plate 12 from rotating via the spacer ring 13 when one magnet plate is rotated optionally.

The holder 11 fitted with the plurality of magnet plates 12 via the spacer rings 13 as described above is further fitted with the lock ring 15 via a spacer ring 14 (substantially the same in configuration as the spacer ring 13).

The lock ring 15 is such that a screw portion is formed on the inner wall surface of a portion where the holder 11 is put in and by fitting the screw portion of the lock ring 15 and the screw portion 11C of the holder 11 so as to rotate the lock ring and holder together, the lock ring 15 is allowed to move in parallel to the direction of the flange 11A. Thus the magnet plates 12 arranged via the respective spacer rings 13 are fixedly tightened by the flange 11A and the lock ring 15 mounted on the holder 11.

More specifically, the lock ring 15 is tightened in the direction of the flange 11A after each of the magnet plates 12 is rotated to complete the convergence regulating operation, so that the rotation of the magnet plates 12 is regulated. At this time, the spacer ring 14 functions to prevent the rotation of the lock ring 15 from being transmitted to the magnet plates 12 because of the tightening of the screw portion.

The convergence regulating means 7 thus adapted is provided with high magnetic permeability members 18 formed of a metal conductor so as to prevent the electron beam from being affected by terrestrial magnetism.

According to this embodiment of the invention, each of the high magnetic permeability members 18 is extended to the outer peripheral face of the holder 11 in the same direction as the center axis of the holder 11 (substantially equal to the center axis of the cathode ray tube).

The provision of the high magnetic permeability members 18 on both sides with respect to the direction in which three electron guns (in the direction x) are located is at least sufficient to prevent the electron beam from being affected by terrestrial magnetism.

Each of the high magnetic permeability members 18 is laid in a groove which is formed in the side portion 11B of the holder 11 and whose depth is substantially equal to the thickness of the high magnetic permeability member 18.

The reason for the high magnetic permeability members 18 to be thus mounted is that the presence of them does not interfere with the smooth rotation of the magnet plates 12 round the side portion 11B of the holder 11.

Figure 4:
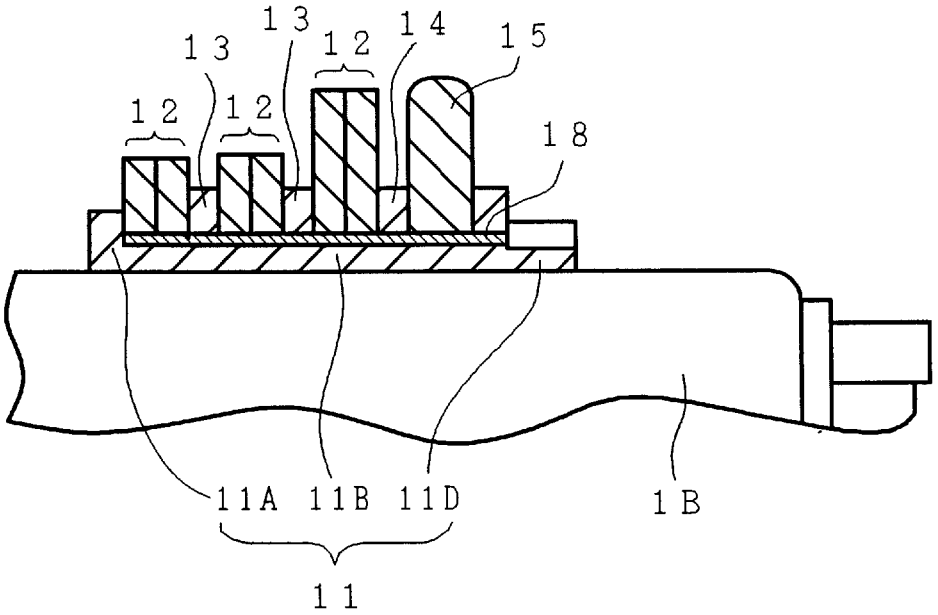
FIG. 4 is a sectional view taken on line B—B of FIG. 1.

FIG. 4 is a sectional view taken on line B—B of FIG. 1.

Thus, the high magnetic permeability members 18 are never brought in direct contact with the neck portion 1B, being set apart by a distance substantially equivalent to the thickness of the side portion 11B of the holder 11.

The convergence regulating means 7 is basically made of insulating material, such as a synthetic resin, except for its component parts including the high magnetic permeability members 18, the metal fitting portion 11D and magnets embedded in the magnet plates 12.

Figure 5:
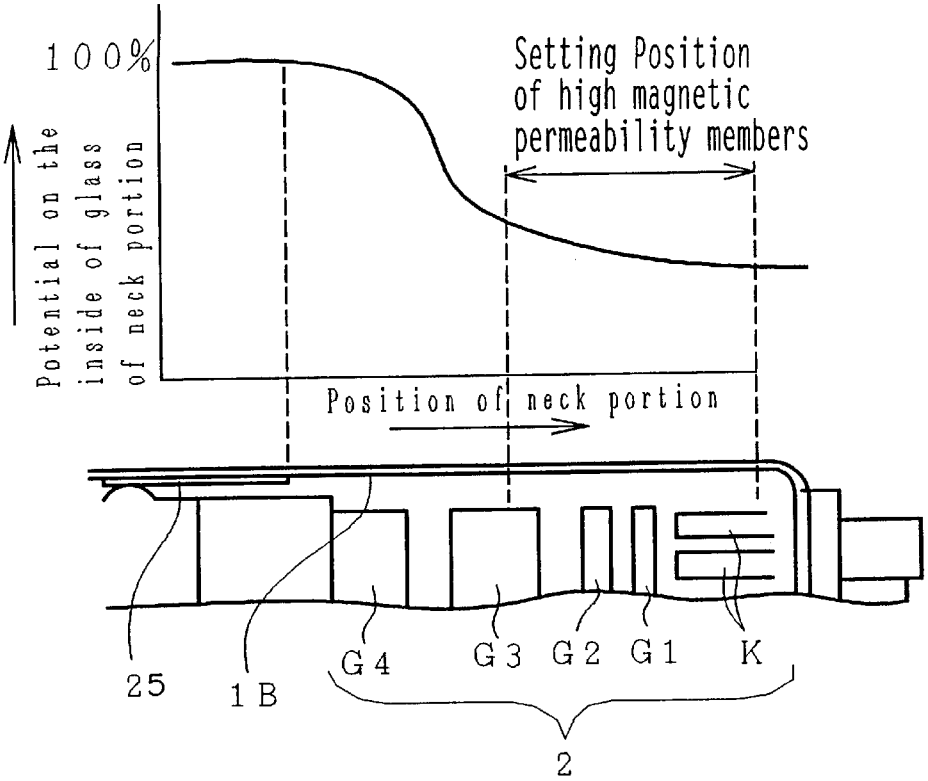
FIG. 5 is a diagram explanatory of the effect of the cathode ray tube according to the present invention.
Figure 6:
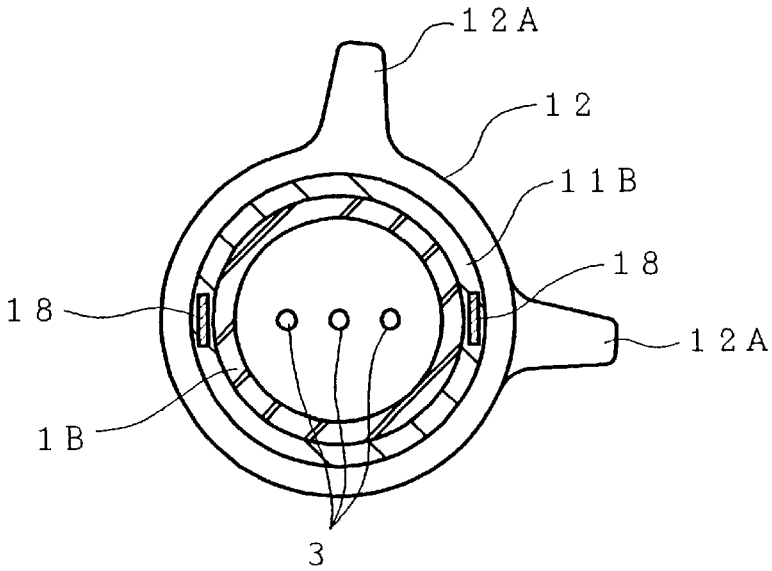
FIG. 6 is a cross-sectional view of the principal part in another cathode ray tube embodying the present invention.

FIG. 5 is a graph indicating positions at which the convergence regulating means 7 of the neck portion 1B is mounted and charging rates inside the neck glass portion in these proximity of the positions. The vertical axis represents the charging rates (the ratio of voltage the neck portion is charged with when the voltage applied to a graphite-applied film is set at 100%), whereas the horizontal axis represents relative positions of the graphite-applied film and the electron gun structure in the neck portion.

In FIG. 5, K represents a cathode; G1, a first grid electrode (a first control electrode); G2, a second grid electrode (a second control electrode); G3 a third grid electrode (a focusing electrode); and G4 a fourth grid (an anode electrode) to which the highest anode voltage is applied out of those constituting the electron gun structure. The cathode K, the first grid electrode G1 and the second grid electrode G2 form a triple-pole portion, which causes electron beams to be generated and directed to an image displaying screen. A main lens for focusing electron beams on the image displaying screen is formed with the focusing electrode G3 and the anode electrode G4, the anode electrode G4 being the final electrode situated closest to the panel portion side among the electric guns.

The graphite-applied film 25 extending from the inner wall surface of the funnel portion 1C is formed so that it has not reached the fitting position of the convergence regulating means 7. However, as shown in FIG. 5, even a place in a position apart from the graphite-applied film 25 is charged with approximately 40–50% of the voltage with which the graphite-applied film 25 is charged, the voltage value normally ranging from approximately 8–15 kV.

Since the anode electrode G4 is made to electrically conduct with the film 25, it has a high potential.

In order to lower the potential difference between the high magnetic permeability members 18 of the convergence regulating means 7 and the inside of the neck glass portion, the high magnetic permeability members 18 are spaced from the surface of the neck portion 1B via an insulating material, which results in improving the pressure resistance of the neck portion 1B thereby.

In order to lower the potential difference between the high magnetic permeability members 18 and the inside of the glass neck portion, each of the high magnetic permeability members 18 has to be so positioned that it is not placed on top of the graphite-applied film 25 across the neck glass. Preferably, the high magnetic permeability members 18 may be placed on the cathode side rather than the side of the G4 electrode to which the highest voltage is applied in the electron gun structure 2. In other words, each of the high magnetic permeability members 18 should be so positioned that it is not placed on top of the G4 electrode across the neck glass, and by placing the end portion of the high magnetic permeability member 18 closer to the G2-electrode-side G3 electrode, the potential difference between the high magnetic permeability member 18 and the inside of the neck glass portion can be lowered.

In the proximity of the cathode K, the high magnetic permeability member 18 may be so positioned that it is laid on top of the cathode K across the neck glass. In other words, it is most preferred to position the high magnetic permeability member 18 so that the high magnetic permeability member 18 extends from the cathode K up to a position near the G2 electrode in the neck portion. The electron beam can be less affected by an external magnetic field in the proximity of the cathode K by thus positioning the high magnetic permeability member 18.

Further, the high magnetic permeability member 18 may preferably be made of low carbon steel having a lower carbon content. According to this embodiment of the invention, the use of an Fe—Si alloy having a silicon content of 1–4%, namely, a so-called silicon steel plate makes good results obtainable.

In the case of a cathode ray tube whose screen had a diagonal line of 51 cm, the pressure resistance of the neck portion 1B was improved by employing a silicon steel plate having a silicon content of 2.4% as the high magnetic permeability member 18 and setting the space between the neck portion 1B and the high magnetic permeability member 18 to at least 0.3 mm.

According to the aforesaid embodiment of the invention, the high magnetic permeability members 18 are placed on the outer peripheral face of the side portion 11B of the holder 11. However, the present invention is not limited to the above-described embodiment thereof, but may be arranged so that the high magnetic permeability members 18 are contained in the side portion 11B of the holder 11.

Even in the above case, the high magnetic permeability members 18 are placeable so as to be not in direct contact with the neck portion 1B and with a sufficient space being held therebetween.

In other words, the provision of an insulating member in between the high magnetic permeability member 18 and the neck portion 1B makes it possible to completely prevent the high magnetic permeability member 18 from directly contacting the neck portion 1B.

From the above standpoint, the high magnetic permeability members 18 are not necessarily placed opposite via the material of the holder 11 to the neck portion 1B, but may be placed in position via an insulating member without being incorporated in the holder 11.

In the case of a so-called large-diameter electron gun where electrodes having a common envelope face three electron beams in a main lens, the smaller the beam-to-beam space S of the three electron beams, the greater the convergence and focusing become improvable, though purity (color purity) remains hardly adjustable. However, the purity becomes readily adjustable because the electron beam can be less affected by an external magnetic field in the proximity of the cathode of the electric gun by applying the high magnetic permeability members 18 to the cathode ray tube equipped with such an electron gun, for example, which has an S dimension of not greater than 5.5 mm.

Direct contact between the high magnetic permeability member 18 and the neck portion 1B may be avoided by, for example, forming not only a sufficiently deep groove in the neck-portion-side inner wall surface of the side portion 11B of the holder 11, but also by positioning the high magnetic permeability member 18 on the bottom of the groove, though this arrangement is inferior in work efficiency and the pressure resistance features of the neck glass to what has been described in the aforesaid embodiment of the invention. In other words, the high magnetic permeability members 18 may be spaced via an air layer from the neck portion 1B.

As is obvious from the description above, the cathode ray tube according to the present invention is adaptable for supressing the deterioration of glass in the neck portion. In other words, the pressure resistance of the neck portion can be increased.

What is claimed is:

1. A cathode ray tube having a glass envelope including a panel portion having an image displaying screen, a neck portion containing an electron gun and a funnel portion for coupling said panel portion and said neck portion, and a convergence regulator which is placed on the outer periphery of said neck portion and is used for regulating the orbit of each electron beam emitted from said electron gun, wherein said convergence regulator includes ring magnets, a cylindrical holder into which said neck portion is fitted and high magnetic permeability members having a dimension thereof extending along a direction of an axis of the cathode ray tube which is larger than a dimension thereof extending in a direction of a circumference of said neck portion, said high magnetic permeability members being arranged so as to be spaced from and in noncontacting relation with the outer peripheral face of said neck portion.

2. A cathode ray tube having a glass envelope including a panel portion having an image displaying screen, a neck portion containing an electron gun and a funnel portion for coupling said panel portion and said neck portion, and a convergence regulator which is placed on the outer periphery of said neck portion and is used for regulating the orbit of each electron beam emitted from said electron gun, wherein said convergence regulator includes ring magnets, a cylindrical holder into which said neck portion is fitted and high magnetic permeability members, said high magnetic permeability members being arranged so as to be spaced from the outer peripheral face of said neck portion;

wherein an insulating member is placed between the outer peripheral face of said neck portion and said high magnetic permeability members.

3. A cathode ray tube as claimed in claim 2, wherein said high magnetic permeability members are disposed at the outer peripheral face of said holder.

4. A cathode ray tube as claimed in claim 2, wherein said high magnetic permeability members are contained in said holder.

5. A cathode ray tube as claimed in claim 2, wherein said high magnetic permeability members comprise an Fe—Si alloy having a silicon content of 1–4%.

6. A cathode ray tube as claimed in claim 2, wherein said electron gun comprises a three-pole portion including a cathode, a first grid electrode and a second grid electrode, a focusing electrode for focusing electron beams on said image displaying screen, and a final electrode to which an anode voltage is applied, wherein said high magnetic permeability members are not positioned above the final electrode are positioned closer to the cathode side than said final electrode.

7. A cathode ray tube as claimed in claim 2, wherein said high magnetic permeability member and said neck portion are spaced by at least 0.3 mm.

8. A cathode ray tube as claimed in claim 2, wherein said high magnetic permeability members extend in a direction of an axis of the cathode ray tube.

9. A cathode ray tube as claimed in claim 8, wherein said high magnetic permeability members are disposed at the outer peripheral face of said holder.

10. A cathode ray tube as claimed in claim 8, wherein said high magnetic permeability members are contained in said holder.

11. A cathode ray tube as claimed in claim 8, wherein said high magnetic permeability members comprise an Fe-Si alloy having a silicon content of 1–4%.

12. A cathode ray tube as claimed in claim 8, wherein said electron gun comprises a three-pole portion including a cathode, a first grid electrode and a second grid electrode, a focusing electrode for focusing electron beams on said image displaying screen, and a final electrode to which an anode voltage is applied, wherein said high magnetic permeability members are not positioned above the final electrode are positioned closer to the cathode side than said final electrode.

13. A cathode ray tube as claimed in claim 8, wherein said high magnetic permeability members and said neck portion are spaced by at least 0.3 mm.

14. A cathode ray tube as claimed in claim 2, wherein said insulating member forms a part of said holder.

15. A cathode ray tube as claimed in claim 14, wherein said high magnetic permeability member comprises an Fe—Si alloy having a silicon content of 1–4%.

16. A cathode ray tube as claimed in claim 14, wherein said electron gun comprises a three-pole portion including a cathode, a first grid electrode and a second grid electrode, a focusing electrode for focusing electron beams on said image displaying screen, and a final electrode to which an anode voltage is applied, wherein said high magnetic permeability members are not positioned above the final electrode and are positioned closer to the cathode side than the final electrode.

17. A cathode ray tube as claimed in claim 14, wherein said insulating member has a thickness of at least 0.3 mm.

18. A cathode ray tube having a glass envelope including a panel portion, a funnel portion and a neck portion containing an inline type electron gun, electron beams being emitted from the electron gun toward the panel portion, wherein an insulating member is placed on the outer peripheral face of said neck portion, and at least one high magnetic permeability member is placed on said insulating member so as to substantially prevent the electron beams from being affected by terrestrial magnetism.

19. A cathode ray tube as claimed in claim 18, wherein said at least one high magnetic permeability member extends in a direction of an axis of the cathode ray tube.

* * * * *